US010376921B2

(12) United States Patent
Hausladen et al.

(10) Patent No.: US 10,376,921 B2
(45) Date of Patent: Aug. 13, 2019

(54) VIBRATOR

(71) Applicant: Liebherr-Components Biberach GmbH, Biberach an der Riss (DE)

(72) Inventors: Norbert Hausladen, Biberach (DE); Viktor Schindler, Uttenweiler (DE)

(73) Assignee: Liebherr-Components Biberach GmbH, Biberach an der Riss (DE)

( * ) Notice: Subject to any disclaimer, the term of this patent is extended or adjusted under 35 U.S.C. 154(b) by 143 days.

(21) Appl. No.: 15/673,249

(22) Filed: Aug. 9, 2017

(65) Prior Publication Data

US 2017/0333947 A1 Nov. 23, 2017

Related U.S. Application Data

(63) Continuation of application No. PCT/EP2016/000224, filed on Feb. 10, 2016.

(30) Foreign Application Priority Data

Feb. 11, 2015 (DE) ..... 20 2015 001 041 U
May 11, 2015 (DE) ..... 20 2015 003 475 U

(51) Int. Cl.
*B06B 1/16* (2006.01)
*E02D 7/18* (2006.01)

(52) U.S. Cl.
CPC ..... *B06B 1/166* (2013.01); *E02D 7/18* (2013.01)

(58) Field of Classification Search
CPC ..... E02D 7/18; E02D 3/046; E02D 3/074; E02D 3/068; B06B 1/167; B06B 1/166; Y10T 74/18552; F16H 3/666
See application file for complete search history.

(56) References Cited

U.S. PATENT DOCUMENTS 3,719,094 A * 3/1973 Borsutzki ..... E02D 3/074 74/87
4,067,244 A * 1/1978 Baumers ..... B06B 1/16 404/133.1
4,471,666 A * 9/1984 Unrath ..... B06B 1/166 173/49
7,598,640 B2 * 10/2009 Heichel ..... B06B 1/166 310/77
9,463,490 B2 * 10/2016 Damm ..... B06B 1/16

FOREIGN PATENT DOCUMENTS

DE 2932287 2/1981
DE 3148437 7/1983
DE 3248437 7/1983

(Continued)

*Primary Examiner* — Jacob S. Scott
*Assistant Examiner* — Lillian T Nguyen
(74) *Attorney, Agent, or Firm* — Levine Bagade Han LLP

(57) ABSTRACT

A vibrator for generating vibrations. An exciter cell having rotationally drivable unbalanced masses that are rotatably supported in an exciter cell housing and having an adjustment unit for adjusting the phase position of the unbalanced masses relative to one another. The adjustment unit is configured as a planetary gearing that has at least two input trains to which the unbalanced masses of the exciter cell are coupled that are adjustable in phase relative to one another and that has an adjustment input train for changing the phase position of the output trains of the planetary gearing.

20 Claims, 2 Drawing Sheets

(56) References Cited

FOREIGN PATENT DOCUMENTS

| | | |
|---|---|---|
| DE | 4439170 | 5/1996 |
| DE | 19920348 | 1/2000 |
| DE | 19631991 | 2/2005 |
| DE | 10356319 | 6/2005 |
| DE | 102011100881 | 11/2012 |
| EP | 0506722 | 9/1994 |
| EP | 1038068 | 6/2001 |
| EP | 2158976 | 3/2010 |
| WO | WO 1991/008842 | 6/1991 |
| WO | WO 2009/049576 | 4/2009 |
| WO | WO 2016/128136 | 8/2016 |

* cited by examiner

VIBRATOR

CROSS-REFERENCE TO RELATED APPLICATIONS

This application is a continuation of International Application No. PCT/EP2016/000224, filed Feb. 10, 2016, which claims priority to German Utility Model No. 20 2015 001 041.5, filed Feb. 11, 2015, and German Utility Model No. 20 2015 003 475.6, filed May 11, 2015, 11 all of which are incorporated by reference herein in their entireties.

BACKGROUND

1) Technical Field

The present invention generally relates to a vibrator for generating vibrations. The invention is in this respect in particular based on an exciter cell having rotationally drivable unbalanced masses that are rotatably supported in an exciter cell housing and having an adjustment unit for adjusting the phase position of the unbalanced masses relative to one another.

2) Description of the Related Art

Vibrators can, for example, be used in the construction industry for pile drivers or for compactors to generate directed vibrations by means of which, for example, sheet pile walls can be rammed into the ground, vibro stone columns can be introduced into the ground or the ground can be compacted or leveled. The ground can optionally also be prepared to facilitate the piling in or pulling out of sheet piles or other construction elements such as posts and the like. The exciter cell of such vibrators that generates vibrations can in this respect be attached to a movable pull yoke of a special underground machine such as drills and/or pile drivers, guide poles or cable excavators by means of which the vibrator unit is typically travelable in a perpendicular direction.

To generate primarily vertical vibrations or vibrations acting in a perpendicular direction, a plurality of shafts or wheels can be received in the exciter cell for this purpose that revolve around parallel, horizontal oriented axes and support unbalanced masses that generate accelerations and thus the desired vibrations by corresponding centrifugal forces during the revolution movement. In this respect the unbalanced masses are split over a plurality of wheels and/or shafts and are coordinated with one another with respect to their arrangement, direction of rotation and phase position such that forces are compensated where possible in the horizontal or lying direction. For this purpose, for example, a plurality of unbalanced masses are arranged at different sides of a plane perpendicular to the axes of rotation and are driven in coordination with one another with respect to phase position and direction of rotation, wherein, for example, unbalanced mass pairs being able to be provided that rotate oppositely to avoid or compensate horizontal vibrations and only to have vertical vibrations.

Such vibrators are known, for example, from the documents EP 05 06 722 B1, EP 10 38 068 B1, DE 44 39 170 A1, DE 10 2011 100 881 A1, EP 21 58 976 A1, DE 103 56 319 A1, DE 199 20 348 A1. WO 2009/049576 A1 or DE 196 31 991 B4.

To be able to set the strength of the vibration force, the phase angles of two unbalanced masses forming an unbalanced mass pair are typically adjusted relative to one another, with the unbalanced masses of such a pair being able to be driven rotationally in the same direction and synchronized with one another so that the centrifugal forces or the unbalanced effects are more or less added or are more or less compensated depending on the phase shift angle set. Whereas a maxim static torque or a maximum unbalance is adopted with a phase angle $\beta=0$, that is with the same orientation or the same angular orientation, with a phase angle $\beta=180°$, that is with mutually oppositely oriented unbalanced masses, the part vibrations effected by the two unbalanced masses mutually compensate one another.

To also be able to carry out such an adjustment of the phase angle between the unbalanced masses during operation, that is with running shafts or wheels of the exciter cell, various adjustment units have already been proposed in the prior art. EP 05 06 722 B1, for example, shows an adjustment via two hydraulic motors that serve as drive motors for the exciter cell. The usable pressure drop can be varied by an adjustable pressure relief valve that is connected downstream of the hydraulic motors and the phase position can hereby be adjusted. EP 2 158 976 B1 proposes for the adjustment of the phase position of the unbalanced masses, driving two unbalanced mass groups that are meshed with one another in the manner of a spur gear by actuators from mutually opposite end faces and providing a further adjustment drive with the help of which the relative phase position can be adjusted between the spur gear stages of the two unbalanced mass groups. DE 199 20 348 A1 uses an interposed adjustable pump for adjusting the phase position on a hydraulic drive of the exciter cell shafts. WO 2009/049576 A1 proposes supporting the unbalanced masses at pivotable carrier arms that can be pivoted with respect to one another by an adjustment mechanism co-rotating on the drive shaft. To adjust the phase angle, it is furthermore known from DE 44 39 170 A1 to use a synchronizer shaft having two spur gears that mesh with the two unbalanced mass groups and can be adjusted relative to one another by an internal hydraulic cylinder such as is also known in a similar manner with camshafts of valve controls.

These already known adjustment units are typically very complex from a construction aspect and are difficult and expensive in manufacture due to expensive special tools and a high number of production steps. They are additionally less maintenance friendly and longer standstill times arise during repairs.

SUMMARY

Starting from this, it is the underlying object of the present invention to provide an improved vibrator of the said kind that avoids disadvantages of the prior art and further develops the latter in an advantageous manner. An adjustment unit should in particular be provided that can be produced inexpensively and simply from a construction aspect, is repair and maintenance friendly and nevertheless also enables a precise adjustment of the vibration strength of the vibrator that is simple to control in operation.

The said object is achieved in accordance with the invention by a vibrator in accordance with claim 1. Preferred embodiments of the invention are the subject of the dependent claims.

It is therefore proposed for the adjustment of the phase position of the unbalanced masses to use a planetary gearing that acts as an adjustable synchronizing stage that, on the one hand, synchronizes the revolutionary movement of the unbalanced masses with one another or coordinates them to one another with respect to their angular speed, but, on the other hand, allows an adjustment of the phase position. In accordance with the invention, the adjustment unit is configured as a planetary gearing that has at least two starting trains to which the unbalanced masses of the exciter cell are coupled that are adjustable in phase relative to one another and that has an adjustment input train for changing the phase position of the output trains of the planetary gearing. The said output trains revolve at mutually coordinated speeds so that the unbalanced masses connected thereto revolve in a correspondingly mutually coordinated manner. The adjustment input train of the planetary gearing can in this respect be held in a position once it has been adopted. The phase position of the adjustment input trains of the planetary gearing and thus the phase position of the unbalanced masses can be adjusted by adjusting the adjustment input train.

Such a planetary gearing has a proven, simple design and can be produced without any special production devices so that stable operation is achieved in an inexpensive manner. At the same time, a precise, sensitive setting of the phase position can also be performed with simple actuators during operation of the exciter cell.

The planetary gearing can in this respect generally be of different designs and can be adapted to the structure of the exciter cell and to the number of the revolving unbalanced mass pairs. A multi-stage planetary gearing can, for example, be provided in the event of a corresponding number of revolving unbalanced masses or exciter cell shafts. To achieve a simple design and a space-saving arrangement, a single-stage planetary gearing can, however, be provided in a further development of the invention that acts as an adjustment unit and can substantially consist of or comprise the assemblies of sun gear, web having planetary gears, and an annular gear.

The connection of the unbalanced masses and of an actuator can in this respect take place at different points of the planetary gearing. Provision can advantageously be made in this respect that the two aforesaid output trains to which the unbalanced masses whose phase angles are to be adjusted are connected are coupled, on the one hand, to the sun gear of the planetary gearing and, on the other hand, to the annular gear of the planetary gearing, while the said adjustment input train can be connected to the planetary gears between the sun gear and the web carrying the annular gear.

A first exciter cell shaft can in particular be rotationally fixedly connected to the sun gear and a second exciter cell shaft can be rotationally connected to the annular gear of the planetary gearing via a spur gear stage such that when the web is held fast—corresponding to a specific set phase position—the two exciter cell shafts revolve synchronously with one another or in a fixed speed ratio with one another as the sun gears and annular gears of the planetary gearing predefine that are coupled to one another by the planetary gears. If the web and thus the planetary gears are adjusted, the phase positions of the exciter cell shafts change with respect to one another.

Unbalanced masses can be coupled to the said first and second exciter cell shafts directly or via further spur gear stages having further exciter cell shafts. The said exciter cell shafts can in this respect be aligned in parallel with one another and/or can adopt an arrangement that is aligned as substantially level, in particular horizontal.

To adjust the phase position, a suitable adjustment actuator that can be actuable via external energy and can be correspondingly controllable by a suitable control unit can be connected to the aforementioned adjustment input train. The said adjustment input train can advantageously comprise a crankshaft to which a pressure medium cylinder can be coupled as an adjustment actuator and with whose aid the crankshaft can be adjusted in a simple manner. Advantageously, the crankshaft acting as an adjustment input or an input shaft optionally configured in another manner can in this respect be directly connected to the web of the planetary gearing in a rotationally fixed manner, with a spur gear stage or another gear transmission stage or reduction stage optionally also being able to be interposed.

An abutment or an abutment pair can advantageously be associated with the adjustment input train, in particular with the aforesaid input shaft and/or the web of the planetary gearing and end positions that can specify the ends of the adjustment range for the phase angle of the unbalanced masses can be predefined with the aid of said abutment or abutment pair. A particularly simply configured adjustment of the unbalanced mass phase position can hereby be achieved in conjunction with the aforesaid pressure medium cylinder as the actuator.

In an advantageous further development of the invention, at least one of the elements of the planetary gearing, in particular its sun gear and/or web and/or annular gear, or an element at the adjustment input train such as the crankshaft or the pressure medium cylinder can have an integrated adjustment device and/or alignment device that enables an adjustment or alignment of the phase position internally in the planetary gearing and thus also of the phase position of the unbalanced masses. One of the said elements can advantageously be configured as adjustable and can comprise two part elements rotatable relative to one another.

The annular gear of the planetary gearing can in particular comprise an outer gear part and an inner gear part that are rotatable with respect to one another and are preferably alignable with one another via elongate holes. Positional tolerances between the input train and the output trains of the planetary gearing can be simply aligned by aligning the two gear parts with respect to one another, whereby the assembly is simplified and more generous production tolerances are enabled. In addition, an orientation of the elements of the adjustment mechanism and of the exciter cell shafts with respect to one another such as of the gears and shafts of the planetary gearing or of the spur gear stage(s) can be omitted.

A fixing device with the help of which a specific, aligned relative position of the gear parts can be fixed can in this respect be associated with the said gear parts, in particular with the aforesaid outer gear parts and inter wheel parts of the annular gear.

To enable a simple maintenance and repair and to avoid longer standstill times on a defect of the adjustment unit, in accordance with a further aspect, the said adjustment unit for adjusting the phase position of the unbalanced masses can be received in a separate adjustment unit housing that can be releasably fastened to the exciter cell housing in which the unbalanced masses are received in a rotatably supported manner. The adjustment unit can in particular be attached to an outer side of the said exciter cell housing. The adjustment unit is hereby simply accessible for the purpose of maintenance and repair and the whole exciter cell does not have to be dismantled or the exciter cell does not have to be opened to be able to carry out maintenance work at the adjustment unit.

The aforesaid planetary gearing can advantageously form an independent assembly that is configured separately from the actual exciter cell that comprises the unbalanced masses drivable in a revolving manner and corresponding exciter cell shafts, said assembly advantageously being able to be demounted from the aforesaid exciter cell as a unit without having to dismantle the exciter cell or having to open the exciter cell housing for this purpose.

Two shaft stubs that project out of the exciter cell housing and onto which or at which two drive wheels of the adjustment unit, in particular the sun gear of the aforesaid planetary gearing stage and a pinion of the aforesaid spur gear stage that meshes or is in engagement with the planetary gearing, can be releasably mounted can form the interface between the said adjustment unit and the actual exciter cell.

The adjustment unit can in this respect be attached to or arranged at the motor side of the exciter cell or to or at a side of the exciter cell disposed opposite the motor side. The adjustment unit can advantageously extend on a transverse side of the exciter cell that extends transversely or substantially perpendicular to the axes of rotation of the unbalanced masses of the exciter cell.

If the adjustment unit and the at least one drive motor of the exciter cell are arranged on oppositely disposed sides of the exciter cell, collision problems can be avoided and both the drive motor and the adjustment unit can be simply mounted without space problems. It is a further advantage that the center of gravity can be placed more closely to the pile driving axis by an oppositely disposed attachment of the drive motor and the adjustment unit so that the pile driving energy can act almost completely in a perpendicular direction and there is practically no wobble movement of the exciter cell. An arrangement of the adjustment unit and of the at least one drive motor on the same exciter cell side, however, can be advantageous, for example, when the installation environment of the vibrator only offers sufficient space on one side.

BRIEF DESCRIPTION OF THE DRAWINGS

The invention will be explained in more detail in the following with reference to a preferred embodiment and to associated drawings. There are shown in the drawings.

DETAILED DESCRIPTION

Figure 1:
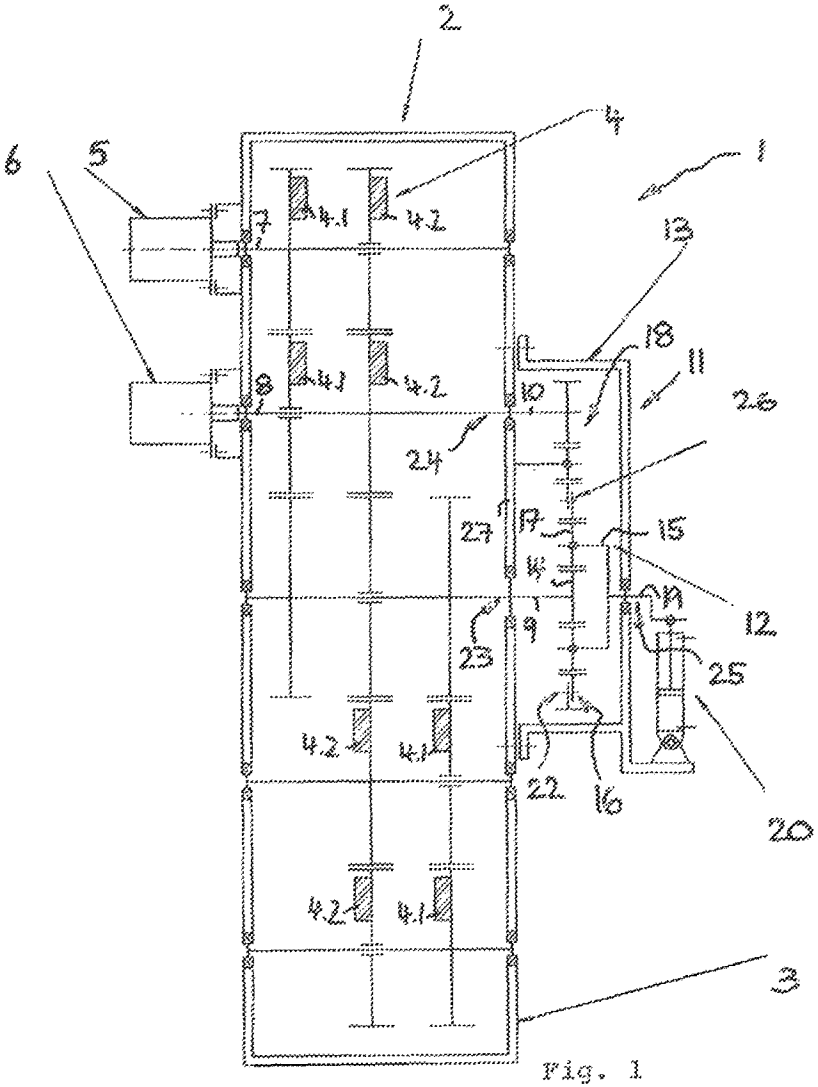
FIG. 1: a schematic sectional view of a vibrator in accordance with an advantageous embodiment of the invention that shows the laterally placed on attachment of the adjustment unit in the form of a planetary gearing and its actuator.

As FIG. 1 shows, the vibrator 1 can have an exciter cell 2 having a plurality of exciter cell shafts that are aligned in parallel and respectively horizontally, that are received in an exciter cell housing 3 and are rotatably supported. The said exciter cell shafts can in this respect be combined into two groups, with the exciter cell shafts of each group being coupled to one another via spur gear stages and accordingly revolving at fixed speed ratios in relation to one another. In this respect, unbalanced masses 4 that can be configured in the form of eccentrically attached unbalanced masses are connected to at least some of the gears connected to the exciter cell shafts. The said exciter cell housing 3 can have bearing and/or fastening sections or parts at the outside by means of which the exciter cell 2 can be mounted to a pull yoke of a construction machine, for example to a drill and/or to a pile drive, of a guide pole or of a cable-operated excavator, or also to a different bearing part of a different construction machine.

The unbalanced masses 4 are in this respect advantageously arranged and coordinated with one another such that on a rotational revolution, they substantially only generate vibrations in a direction 27 that can in particular be aligned at least approximately vertically on a proper installation and position of work of the vibrator 1, cf. FIG. 1.

In accordance with the drawn embodiment in accordance with FIG. 1, the exciter cell shafts (e.g., shafts 23 and 24) and the unbalanced masses 4 connected thereto can be driven in a rotationally revolving manner by two or more drive motors 5 and 6. Alternatively, however, only one drive motor can also be provided to drive all the unbalanced masses. In accordance with the drawn embodiment in accordance with FIG. 1, a first drive motor 5 in this respect drives the first group of unbalanced masses 4.1 via a drive shaft 7 whose drive movement is transmitted onto the said further unbalanced masses 4.1 via different spur gear stages and is forwarded up to an exciter cell shaft 9. A second drive motor 6 drives a second group of unbalanced masses 4.2, and indeed via a further drive shaft 8 that drives the further unbalanced masses 4.2 via corresponding spur gear stages and simultaneously forms a second exciter cell shaft 10 that, together with the aforesaid first exciter cell shaft 9, is led out of the exciter cell housing 3 such that the two energy cell shafts 9 and 10 project as a shaft stub into the adjustment unit 11. As FIG. 1 shows, the said adjustment unit 11 can in this respect be arranged at the side of the exciter cell 2 disposed opposite the drive motors 5 and 6. The drive motors 5 and 6 can, however, also be arranged at the other unbalanced mass shafts and/or at the shaft 23.

The said adjustment unit 11 comprises a planetary gearing 12 that is received in an adjustment unit housing or planetary gearing housing 13 that is separate from the exciter cell housing 3 and that can be placed onto the outside of the exciter cell housing 3.

As FIG. 1 shows, the adjustment unit housing 13 can be formed in pot shape, with a wall of the exciter cell housing 3 closing the adjustment unit housing 13 and/or being able to form a separator wall between the adjustment unit and the exciter cell. Alternatively, the adjustment unit housing 13 can, however, also be substantially completely closed, with the adjustment unit housing 13 and the exciter cell housing 3 being able to be seated on one another wall to wall. The adjustment unit housing 13 can advantageously be separately removed or dismantled without the exciter cell housing 3 having to be opened for this purpose.

The said planetary gearing 12 can be formed in a single stage and can have a sun gear 14 that can be arranged coaxially to an annular gear 16 of the planetary gearing 12. Planetary gears 17 can be arranged between the sun gear 14 and the annular gear 16 and can be in rolling engagement both with the sun gear 14 and with the annular gear 16 and can be rotatably supported at a web 15. The said web 15 can itself be rotatably supported and is arranged coaxially to the axes of the sun gear 14 and of the annular gear 16.

As FIG. 1 shows, the said sun gear 14 can be rotationally fixedly connected to the aforesaid first exciter cell shaft 9. The aforesaid second exciter cell shaft 10 can be rotationally coupled to the annular gear 16 via a spur gear stage 18, with the said spur gear stage 18 being able to be in rolling engagement with the outer gear 16*a* or the outer periphery of the said annular gear 16.

Accordingly, the two exciter cell shafts 9 and 10 and thus the said groups of unbalanced masses 4 and the drive motors 5 and 6 connected thereto are rotationally coupled to one another via the planetary gearing 12 such that they revolve correspondingly synchronously or at a fixed speed ratio with respect to one another.

To be able to adjust the phase position of the unbalanced masses 4 with respect to one another, the said web 15 of the planetary gearing 12 can be adjusted or rotated. For this purpose, an input shaft 19 that can be rotationally fixedly connected to the said web 15 can be connected to an actuator 20 that can advantageously be supported at the adjustment unit housing 13. As FIG. 1 shows, the said actuator 20 can be configured in a simple manner as a pressure medium cylinder that can rotationally adjust the input shaft 19 configured as a crankshaft 25.

Figure 2:
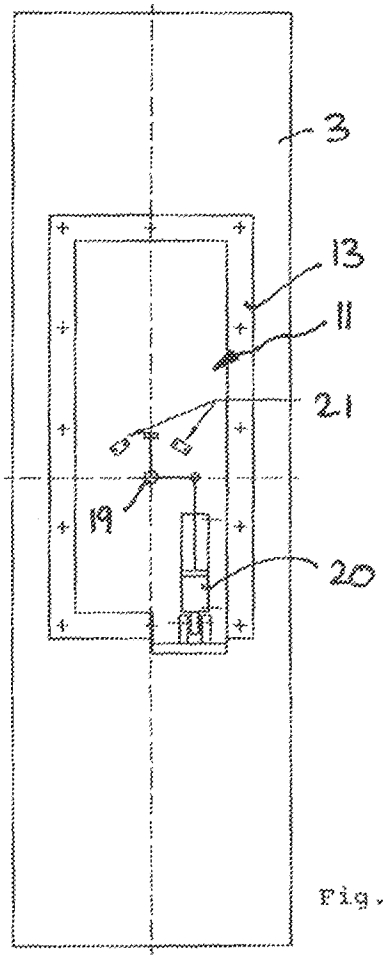
FIG. 2: a plan view of the vibrator and its adjustment unit of FIG. 1 that shows the arrangement of the adjustment actuator and the end abutments limiting the adjustability of the phase angle position.

As FIG. 2 shows, the adjustability of the input shaft 19 and thus of the web 15 can be bounded by end abutments 21 such that the web 15 of the planetary gearing 12 can be moved in a simple manner to and fro between two end positions by the pressure medium cylinder. Depending on the desired configuration, the said actuator 20 can also be stopped and/or fixed in intermediate positions to be able to set intermediate positions continuously or step-wise.

Figure 3:
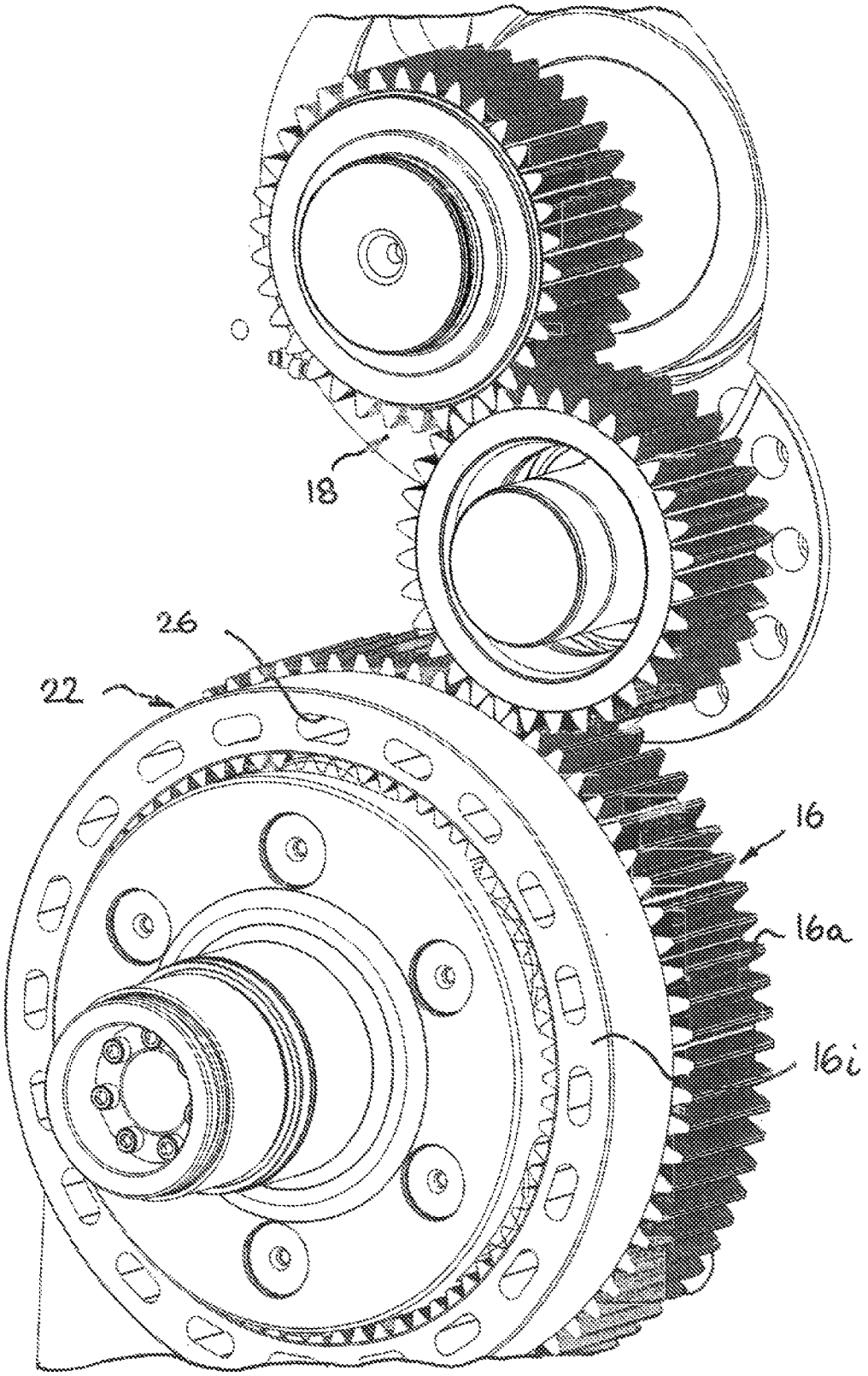
FIG. 3: a detailed perspective and schematic representation of the annular gear of the planetary gearing of FIG. 1 and the spur gear stage meshing therewith, with the annular gear rotationally adjustable in itself being shown with inner and outer gears of the annular gear that are adjustable with respect to one another via elongate holes.

As FIG. 1 and FIG. 3 show, the planetary gearing 12 can comprise an internal alignment or adjustment device 22, with one of the gears of the planetary gearing in particular being able to be configured as rotatable in itself. The annular gear 16 can in particular have an inner gear 16*i* and an outer gear 16*a* that can be rotated relative to one another via elongate holes 26 and that can be brought into different rotational positions relative to one another such that the relative position of the two exciter cell shafts 9 and 10 connected to the planetary gearing 12 can be aligned relative to one another or the relative position of these exciter cell shafts 9 and 10 to the input shaft 19 can be aligned in that the said inner and outer gears 16*i* and 16*a* of the annular gear 16 are displaced with respect to one another. Direct gear teeth orientations at the crankshaft 19, web 15, exciter cell shaft 9, 10, sun gear 14 and/or spur gear stage 18 can hereby be dispensed with or positional tolerances in the total gear teeth chain can generally hereby be compensated.

We claim:

1. A vibrator for generating vibrations comprising:

rotationally drivable unbalanced masses that are rotatably supported in an exciter cell housing;

an adjustment unit for adjusting the phase position of the unbalanced masses relative to one another, wherein the adjustment unit comprises a planetary gearing connected to two output trains, wherein the unbalanced masses are coupled to the output trains, and wherein the unbalanced masses are adjustable in phase relative to one another; and an adjustment input train for adjusting the phase position of the output trains relative to one another, wherein at least one of the two output trains is connected to a sun gear, wherein the other of the at least one of the two output trains is connected to a ring gear, and wherein the adjustment input train is connected to a carrier of the planetary gearing.

2. The vibrator of claim 1, wherein the planetary gearing comprises a single-stage gearing.

3. The vibrator of claim 1, wherein the at least one of the two output trains connected to the sun gear comprises a first exciter cell shaft rotationally fixedly connected to the sun gear, and wherein the other of the at least one of the two output trains connected to the ring gear comprises a second exciter cell shaft that is rotationally coupled to the rotatably supported ring gear of the planetary gearing via a spur gear stage.

4. The vibrator of claim 3, wherein the first and second exciter cell shafts are aligned in parallel with one another and/or in a lying position.

5. The vibrator of claim 1, wherein the adjustment input train comprises an adjustment shaft, and wherein the adjustment shaft is rotationally fixedly connected to the carrier of the planetary gearing and can be brought into different rotational positions by an actuator.

6. The vibrator of claim 5, wherein the actuator comprises a pressure medium cylinder, and wherein the pressure medium cylinder is configured to engage the adjustment input train of the planetary gearing, wherein the adjustment input train of the planetary gearing comprises a crankshaft.

7. The vibrator of claim 1, wherein stoppers are associated with the adjustment input train, and wherein the stoppers predefine rotational end positions between which the phase position of the unbalanced masses is adjustable.

8. The vibrator of claim 1, wherein at least one of the sun gear, carrier, and ring gear of the planetary gearing is configured as adjustable in itself and has two part elements that are rotatable relative to one another and are fixable in different rotary positions relative to one another.

9. The vibrator of claim 1, wherein the ring gear of the planetary gearing comprises an inner gear part and an outer gear part that are rotatable with respect to one another and alignable with one another via elongate holes.

10. The vibrator of claim 1, wherein the adjustment unit is in an adjustment unit housing configured separately from the exciter cell housing, and wherein the adjustment unit housing is releasably fastened to the exciter cell housing.

11. The vibrator of claim 1, wherein the adjustment unit is attached to an outer side of the exciter cell housing, and wherein an exciter cell housing wall and/or a distributor unit housing wall form a separator wall between the exciter cell and the adjustment unit.

12. The vibrator of claim 11, wherein the adjustment unit is arranged at a transverse side of the exciter cell housing that extends perpendicular to the axes of rotation of the unbalanced masses.

13. The vibrator of claim 1, wherein the adjustment unit and at least one drive motor for a rotational drive of the unbalanced masses are on oppositely disposed sides of the exciter cell housing.

14. The vibrator of claim 1, wherein the adjustment unit is independent of and dismantlable from the exciter cell housing.

15. A method for using the vibrator of claim 1 with a construction machine, and where the construction machine comprises a pile driver and/or a drill, and wherein the exciter cell of the vibrator is attached to an adjustable pull yoke.

16. A vibrator for generating vibrations comprising:

rotationally drivable unbalanced masses that are rotatably supported in an exciter cell housing;

an adjustment unit for adjusting the phase position of the unbalanced masses relative to one another, wherein the adjustment unit comprises a planetary gearing connected to two output trains, wherein the unbalanced masses are coupled to the output trains, and wherein the unbalanced masses are adjustable in phase relative to one another; and an adjustment input train for adjusting the phase position of the output trains relative to one another, wherein stoppers are associated with the adjustment input train, and wherein the stoppers predefine rotational end positions between which the phase position of the unbalanced masses is adjustable.

17. The vibrator of claim 16, wherein the planetary gearing comprises a single-stage gearing.

18. The vibrator of claim 16, wherein at least one of the two output trains is connected to a sun gear, wherein the other of the at least one of the two output trains is connected to a ring gear, and wherein the adjustment input train is connected to a carrier of the planetary gearing.

19. The vibrator of claim 16, wherein the adjustment unit is in an adjustment unit housing configured separately from the exciter cell housing, and wherein the adjustment unit housing is releasably fastened to the exciter cell housing.

20. The vibrator of claim 16, wherein the adjustment unit is attached to an outer side of the exciter cell housing, and wherein an exciter cell housing wall and/or a distributor unit housing wall form a separator wall between the exciter cell and the adjustment unit.

* * * * *